US006283513B1

(12) United States Patent
Yeh

(10) Patent No.: US 6,283,513 B1
(45) Date of Patent: Sep. 4, 2001

(54) LOCKING DEVICE FOR A TWO-DOOR UNIT OF SWINGING TYPE

(76) Inventor: Wen Tien Yeh, No. 1-6, Ta Lee Street, Taipei (TW)

( * ) Notice: Subject to any disclaimer, the term of this patent is extended or adjusted under 35 U.S.C. 154(b) by 0 days.

(21) Appl. No.: 09/385,576

(22) Filed: Aug. 30, 1999

(30) Foreign Application Priority Data

May 7, 1999 (TW) ..... 88207282

(51) Int. Cl.[7] ..... E05B 65/10
(52) U.S. Cl. ..... 292/92; 292/DIG. 65
(58) Field of Search ..... 292/63–65, 67, 292/92, 93, 169, DIG. 65, 177

(56) References Cited

U.S. PATENT DOCUMENTS 202,474 * 4/1878 Ruggles ..... 292/63
1,244,443 * 10/1917 Hurd ..... 292/92
2,718,420 * 9/1955 Teetor ..... 292/64
3,799,591 * 3/1974 Taniyama ..... 292/71
4,005,886 * 2/1977 Lirette ..... 292/177
4,099,753 * 7/1978 Gwodz ..... 292/177
5,527,074 * 6/1996 Yeh ..... 292/177

* cited by examiner

*Primary Examiner*—Gary Estremsky
(74) *Attorney, Agent, or Firm*—Shoemaker and Mattare

(57) ABSTRACT

An improved locking device is provided for use on a pair of panic doors. The locking device includes an actuating bolt including a triangularly-shaped body and being formed with a stopper portion and a recessed portion; a curved pivotabie member which is formed with a pair of opposite guide pegs slidably abutting on the stopper portion on the actuating bolt and is pivotably turnable when the actuating bolt is being pushed inwards; a movable tube which is axially movabvle when the curved pivotable member is being pivotally turned; a slidable bar which is slidable with the axial movement of the movable tube; and a latching bolt linked to the slidable bar so that when the slidable bar is moved the latching bolt is protruded out of the locking device to lock the paired panic doors. It is a chacteristic feature of this locking device that the exerting force can be applied at various angles to the actuating bolt, while nevertheless allowing the actuating bolt be smoothly pushed inwards to actuate the latching bolt to lock the paired panic door.

5 Claims, 11 Drawing Sheets

LOCKING DEVICE FOR A TWO-DOOR UNIT OF SWINGING TYPE

BACKGROUND OF THE INVENTION

1. Field of the Invention

This invention relates to locking means, and more particularly, to an improved locking device for a pair of panic doors.

2. Description of Related Art

A pair of panic doors are typically provided with a special type of locking device that includes an actuating bolt and a latching bolt and operates in such a manner that, when the door is closed, one of the two door panels will urge against the actuating bolt mounted on the other door panel which in turn actuates the latching bolt to be protruded out to a recessed portion in the doorframe or floor, whereby the paired panic doors are locked by the locking device. One type of this locking device is illustratively depicted in the following with reference to FIG. 1 through FIG. 4.

FIG. 1 is a schematic side view of a coxventional locking device for a pair of panic doors, which is disclosed in U.S. Pat. No. 5,527,074. As shown, the locking device 1' is mounted on one door panel of a pair of panic doors. The locking device 1' includes an actuating bolt 8'. In FIG. 1, the actuating bolt 8' is protruded out of the swinging stile 11' of the door panel. When the other door panel (not shown) of the paired panic doors is closed, it will run into the actuating bolt 8', thereby pushing the actuating bolt 8' to the inside of the locking device. This action then causes a curved pivotable member 9' to be pivotally turned about an pivotal axis 71' disposed in a mounting casing 7' for accommodating the actuating bolt 8' and curved pivotable member 9', as illustated in FIG. 2. In consequence, the curved pivotable member 9' urges against an L-shaped board 51' provided at the bottom of a movable tube 5', thereby pushing the movable tube 5' to move upwards, and consequently causing a slidable bar 6' to move upwards. The upward moving of the slidable bar 6' then causes a latching bolt 61' to be protruded out of the top plate 12' into a recess 130' formed in the doorframe 13', whereby the paired panic doors are locked to the doorframe 13'.

FIG. 3 is a schematic exploded perspective view of the actuating mechanism in the locking device of FIG. 1 (i.e., the combined structure of the actuating bolt 8' and the curved pivotable member 9'). As shown, the actuating bolt 8' is subgtantially triangular in shape having inclined surfaces with respect to its moving directon, and is integraly formed with a block having a crosswise guide slot 81' for accommodating the guide pegs 90' on the curved pivotable member 9' and a longitudianal slot 82' for accomodating the main body of the curved pivotable member 9' . When the paired panic doors are closed, it will urge against the inclined surface of the actuating bolt 8', thereby pushing the actuating bolt 8' inward, consenquently causing the curved pivotal member 9' to be turned about the pivotable axis 71', of a mountig 7' for accomodating the actuating bolt 8' and curved pivotable member 9' as shown in FIGS. 4A through 4C. FIG. 4A shows a top view of the actuating mechanism when the actuating bolt 8' is protruded out of the swinging stile 11'; and FIG. 4B shows a top view of the same except when the actuating bolt 8' is being pushed inward.

One drawback to the forgoing locking device, however, is that the actuating bolt 8' could be easily tilted, as illustrated in FIG. 4C, if the direction of the exerting force F is unaligned with the longitudianl axis of the actuating bolt 8', which would cause the actuating bolt 8' to be unsmoothly pushed into the casing of the locking device. One solution to this problem is to apply lubricant to the actuating bolt 8'. However, the provided effect would be unsatisfactory.

Still one drawback to the foregomg locking device is that the forming of the cross-wise slot 81' and the lorgtudinal slot 82' in the actuating bolt 8' is quite laborious and complex in machining, causing the manufacture cost to be undesirably high.

SUMMARY OF THE INVENTION

It is therefore an objective of this invention to provide a locking device for paired panic doors, whose actuating bolt would not be tilted when being pushed inward, so that the actuating mechanism can be operated more smoothly than the prior art.

It is another obective of this invention to provide a log device for paired panic doors, which can be maufactured in a more cost-effective manner.

In accordance with the foregoing other objectives, the invention provides an improved locking device for paired panic doors. The locking device of the invention comprises an actuating bolt including a triangularly-shaped body and being formed with a stopper porton and a recessed portion; a pivotable member which is formed with a pair of opposite guide pegs slidably abutting on the stopper portion on the actuating bolt and is pivotably turnable when the actuating bolt is being pushed inwards, a movable tube which is axially movable when the pivotable member is being pivotally turned; a slidable bar which is slidable with the axial movement of the movable tube; a member spring sleeved to the slidable bar, and a latching bolt linked to the slidable bar so that when the slidable bar is axially moved, the latching bolt is protruded out of the locking device for locking purpose.

It is a characteic feature of this locking device that the external force can be aplied at various angles to the actuating bolt, while nevertheless allowing the actuating bolt be smoothly pushed inwards to actuate the latching bolt to lock the paired panic doors.

BRIEF DESCRIPTION OF DRAWINGS

The invention can be more fully understood by reading the following detailed description of the preferred embodiments, with reference made to the accompanying drawings, wherein.

DETAILED DESCRIPTION OF PREFERRED EMBODIMENTS

A preferred embodiment of the locking device for a pair of panic doors according to the invention is disclosed is the following with reference to FIG. 5 through FIG. 11.

Figure 5:
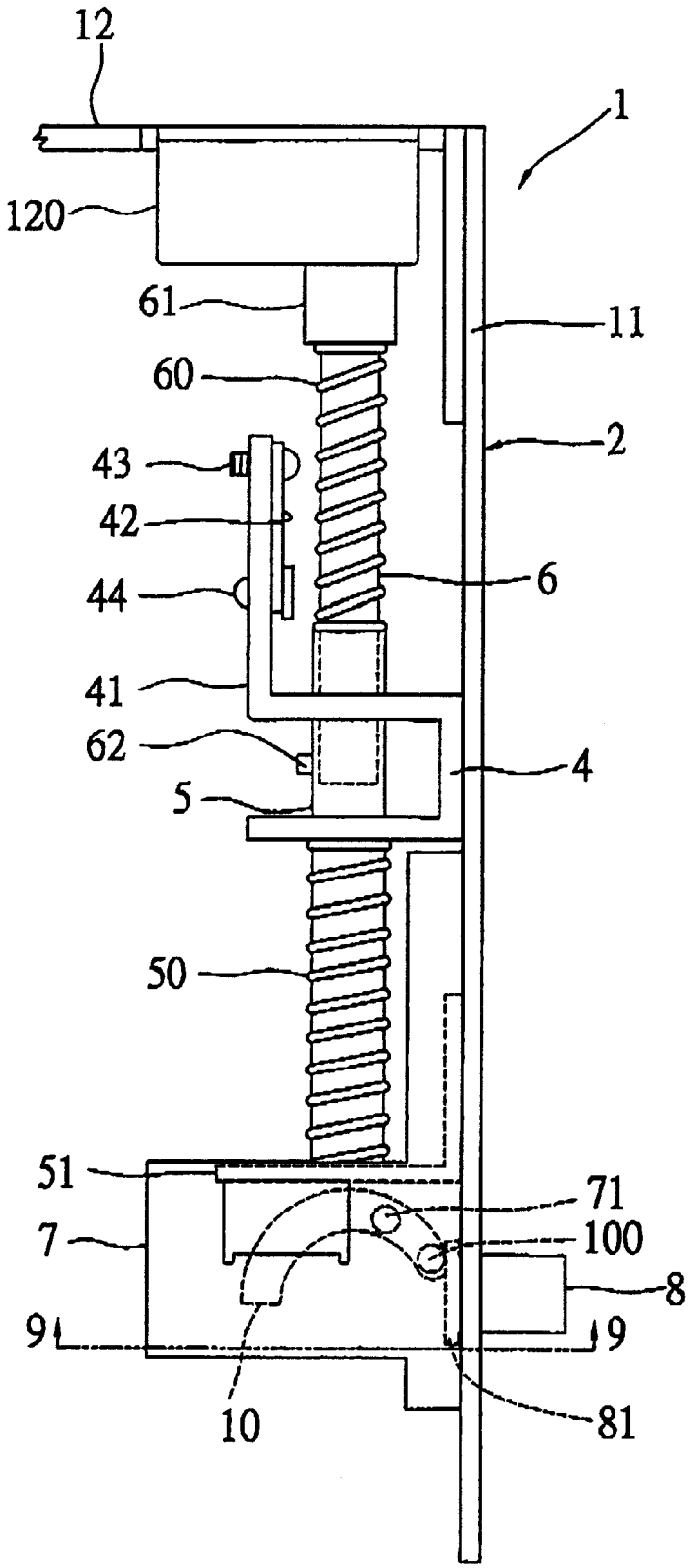
FIG. 5 is a schematic side view of the locking device according to the invention.
Figure 6:
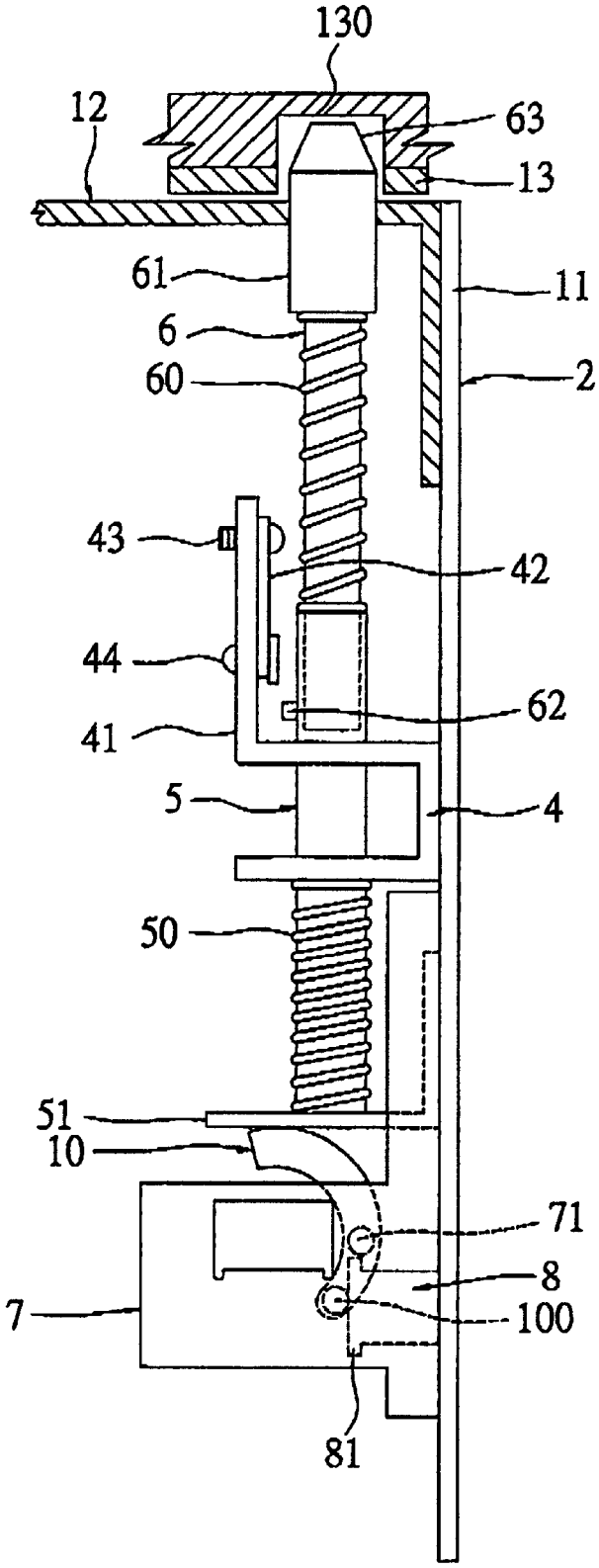
FIG. 6 shows the same of FIG. 5 except when the actuating bolt is being pushed inwards.

Referring first to FIG. 5, the locking device of the invention, here designated by the reference numeral 1, is mounted on one door panel 2 of a pair of panic doors. The door panel 2 includes a mounting frame 4 and a mounting case 7 attached to a swinging stile 11 of the door panel 2. The mounting frame 4 includes an upright portion 41 which is mounted with a fire-proof elastic piece 42 having one end fixed by a screw 43 and the other end fixed to a thermal member 44. The mounting case 7 is fixed to the panel 2 and is used to accommodate an actuating mechanism which includes an actuating bolt 8 and a curved pivotable member 10.

Figure 7:
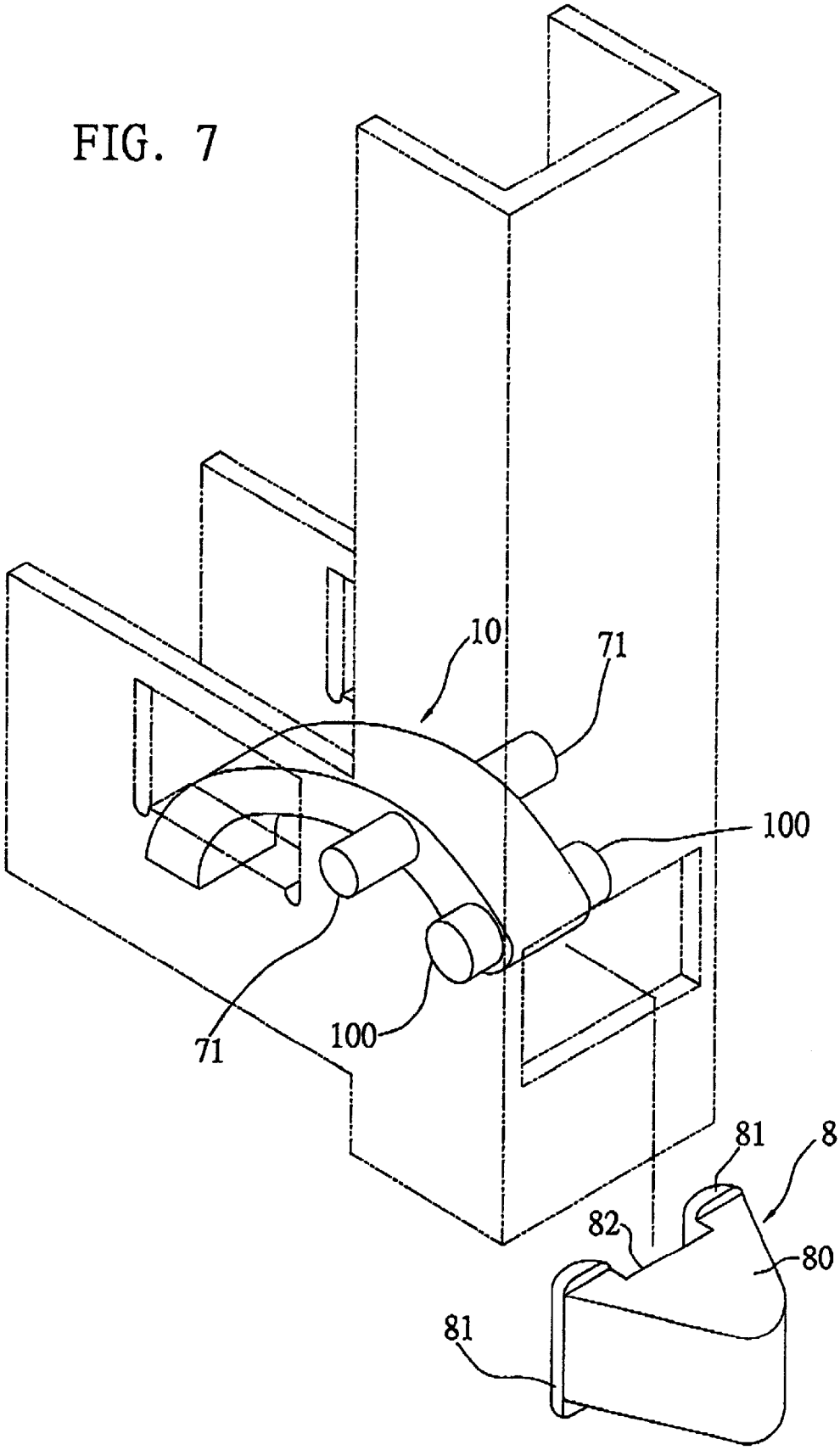
FIG. 7 is a schematic exploded perspective view of the actuating mechanism in the locking device of the invention.

As shown in FIG. 7, it is a distinguishing feature of the invention that the actuating bolt 8 includes a triangularly-shaped body 80 having lined surfaces with respect to its moving direction and is formed with a stopper portion 81 and a recessed portion 82. The stopper portion 81 is used to prevent the actuating bolt 8 from protruding out of the swinging stile 12 while no external force is exerted on the actuating bolt 8 to depess the actuating bolt 8 to the inslde of the loking device 1. The curved pivotable member 10 is formed with a pair of opposite guide pegs 100 slidably abutting on the stopper portion 81 of the actuating bolt 8 and is pivotable about a pivotal axis 71 disposed in the mounting casing 7.

Refering back to FIG. 5, the locking device of the invention further includes a movable tube 5 upright and slidably coupled with the mounting frame 4. The movable tube 5 has a bottom end linked to a substantially L-shaped piece 51, which is slidably abutted on the curved pivotable memer 10. Further, a first coil spring 50 is sleeved to the movable tube 5 within the section between the L-shaped piece 51 and the mounting frame 4. Moreover, a slidable bar 6 is slidably mounted on the upper section of the movable tube 5. The slidable bar 6 has an upper end linked to a latching bolt 61. The latching bolt 61 is positioned in a U-shaped frame 120 mounted to the top plate 12 of the door panel 2. When urged upwards, the latching bolt 61 can be protruded out of the top plate 12 into a recess 130 formed in the doorframe 13 or the floor on which the paired panic doors are mounted.

Figure 8:
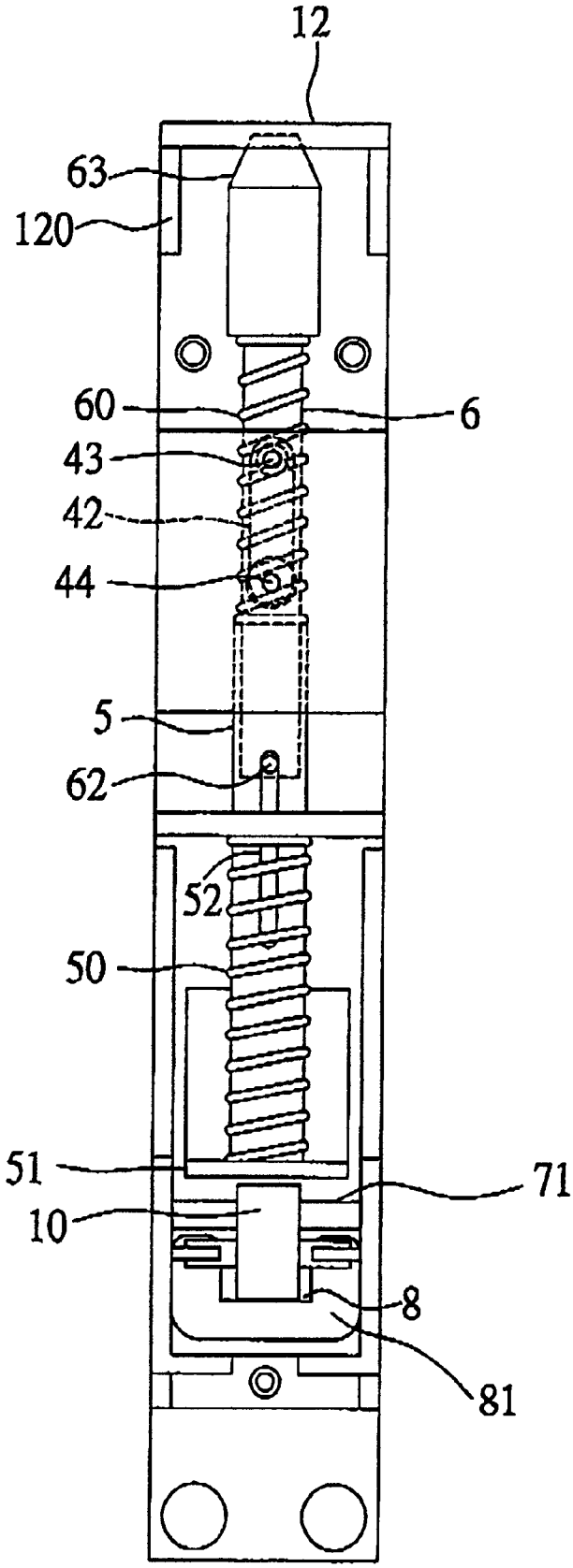
FIG. 8 shows another side view of the locking device of the invention.

Referring to FIG. 8, the movable tube 5 is formed vith a longitudinal slot 52, while the sidable bar 6 is formed with a peg 62 slidably set in the longitudinal slot 52. Further, a second coil spring 60 is sleeved on the slidable bar 6 between the latching bolt 61 and the moving tube 5. By means of the peg 62, the slidable bar 6 is prevented from being separated from the movable tube 5. The second coil spring 60 can help the latching bolt 61 and the slidable bar 6 restore to their original positions after being displaced.

In use, the actuating bolt 8 is protruded out from the mouting case 7 when the other door panel of the paired panic door is opened, as illutrated in FIG. 5. When the other panel of the paired panic doors is closed, it will urge against the actuating bolt 8, thereby pusbing the actuating bolt 8 inward and consequently causing the curved pivotable member 9 to be pivotally turned. In consequence, the curved pivotable member 9 urges against the L-shaped piece 51, they pusiag the L-shaped piece 51 to move upwards, causing the fist coil spring 50 to be conpressed and the movable tube 5 and the slidable bar 6 to be pushed to move upwards. As a result, the latching bolt 61 is protruded out of the U-shaped frame 120 into the recess 130 in the doorframe 12, thereby locking the paired panic door. Thereafter, when the other door panel of the paired panic doors is opened, the actuating bolt 8 will be released to the protruding position due to the elastic restoring force from the compressed first coil spring 50 as well as second coil spring 60.

Figure 9A:
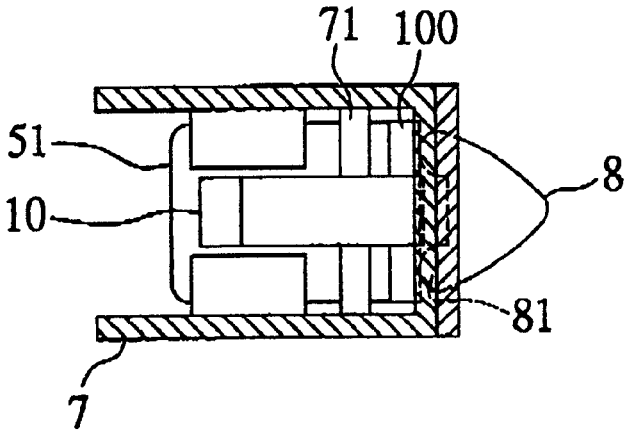
FIG. 9A is a schematic sectional view showing the part of the locking device of FIG. 5 cutting through the line 9—9 with the actuating bolt being protruded out.
Figure 9B:
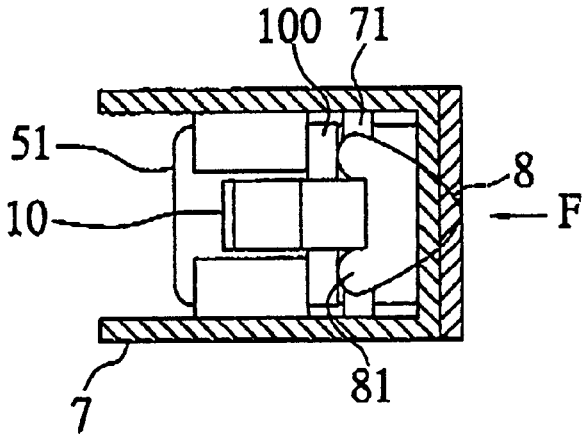
FIG. 9B shopws the same of FIG. 9A except when the actuating bolt is being pushed inwards.

It is a characteristic feature of the invention that the triangularly-shaped body 80 of the actuating bolt 8 allows the actuating bolt 8 to be pushed inwards when the other door panel of the paired panic doors is closed. FIG. 9A is a schematic sectonal view of the actuating mechanism in the locking device 1 of FIG. 5 cutting through the line 9—9, with the actuating bolt 8 being protruded out. FIG. 9B shows the same of FIG. 9A except when the actuating bolt 8 is being pushed inwards. In the case of FIG. 9B, exerting force F is straght aligned with the longitudinal axis of the actuating bolt 8; and therefore, the actuating bolt 8 can be pushed smootly into the locking device.

Figure 9C:
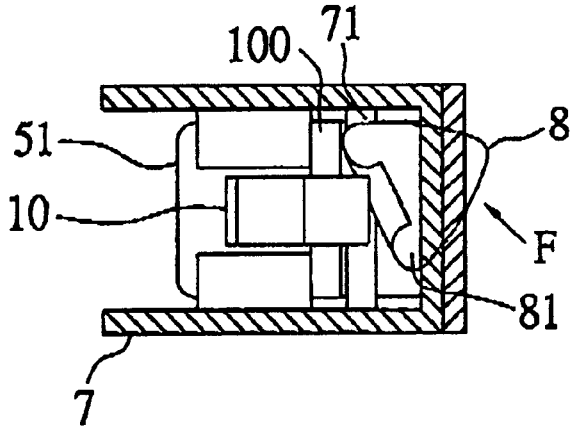
FIG. 9C shows the same of FIG. 9B except when the actuating bolt is undesirably tilted, which is used to depict that the tilting of the actuating bolt would not affect the smooth operation of the actuating mechanism.
Figure 10:
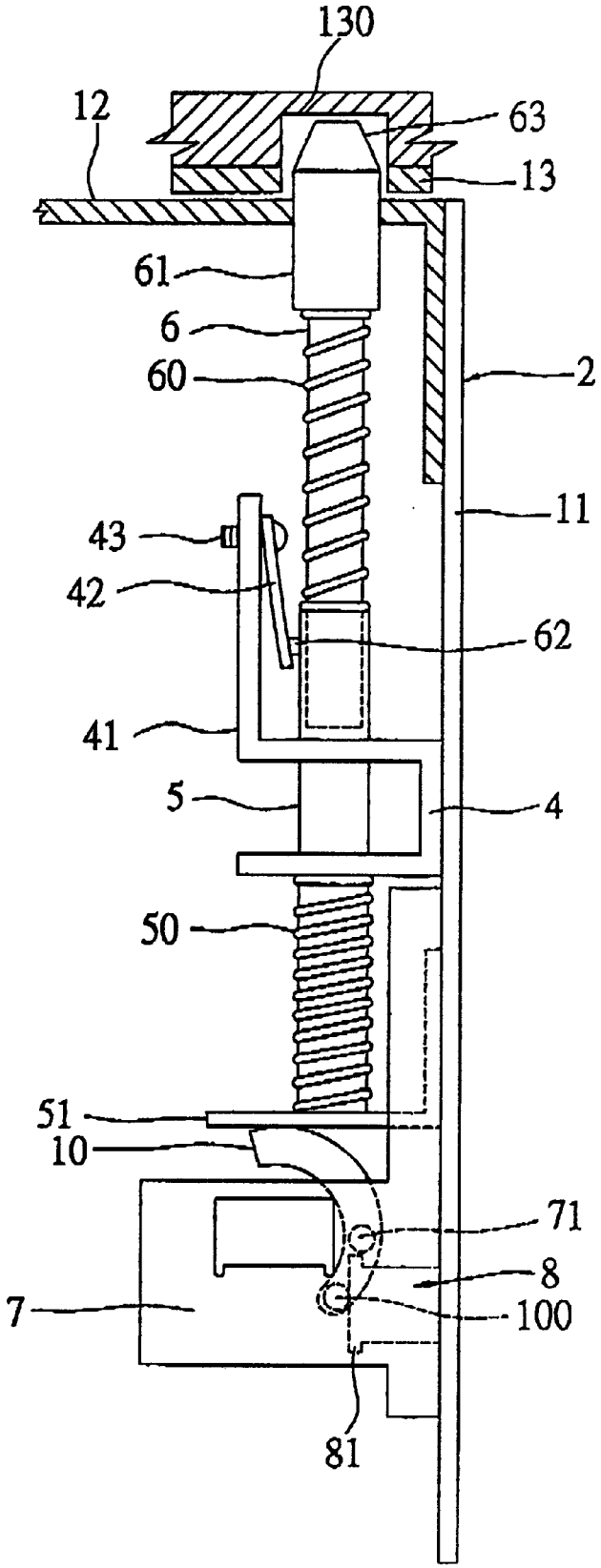
FIG. 10 shows the same of FIG. 5 except when the thermal device is melted down in the event of a fire.

FIG. 9C shows the case when the direction of the exerting force F is unaligned to the longitudinal axis of the actuating bolt 8. In this case, the acuaing bolt 8 can nevertheless slide into the mounting case 7, with the stopper potion 81 exerting against the guide pegs 90 of the curved pivotable member 9, thereby allowing the actuating bolt 8 to be smoothly pushed into the mounting case 7 without having to use lubricant as in the case of the prior art.

Figure 1:
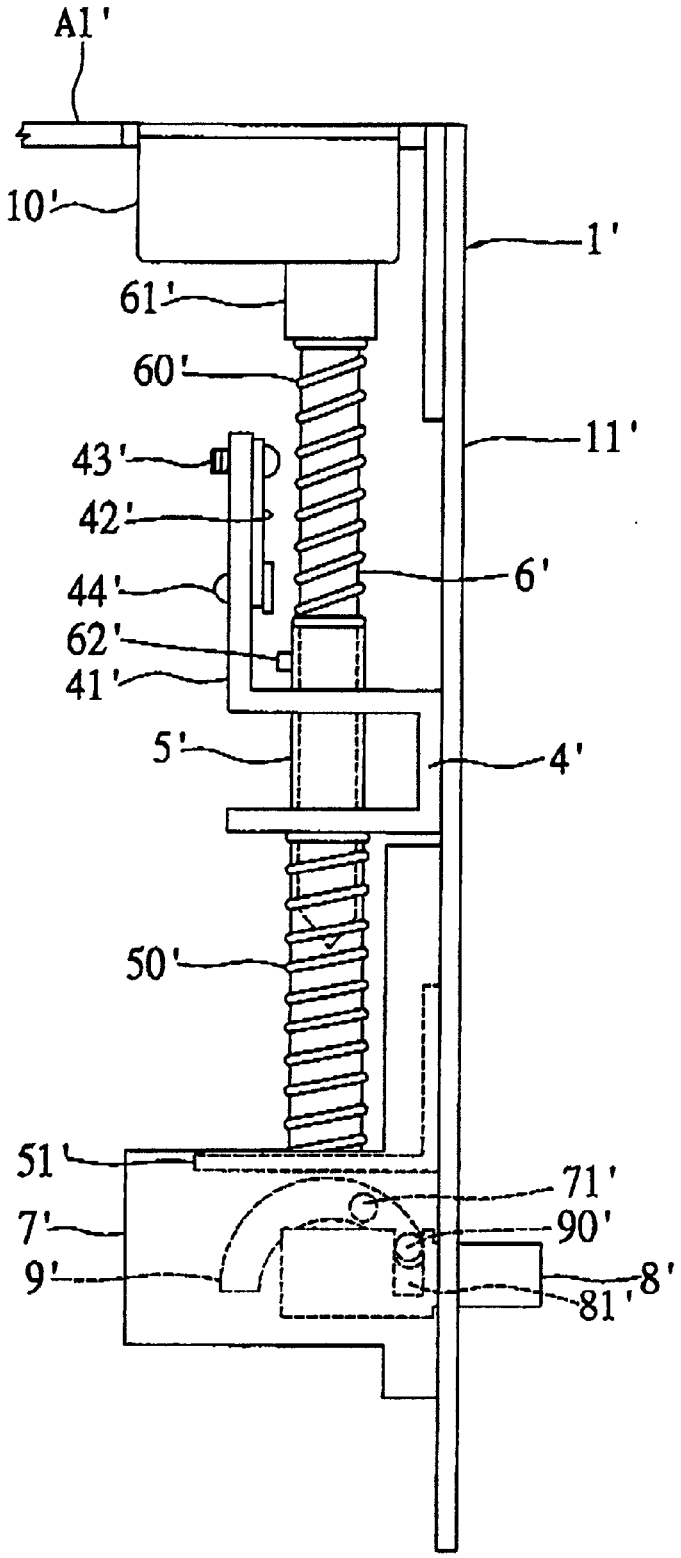
FIG. 1 (PRIOR ART)
FIG. 1 (PRIOR ART) is a schemtic side view of a conventional locking device for a pair of panic doors when the actuating bolt is protruded out.
Figure 2:
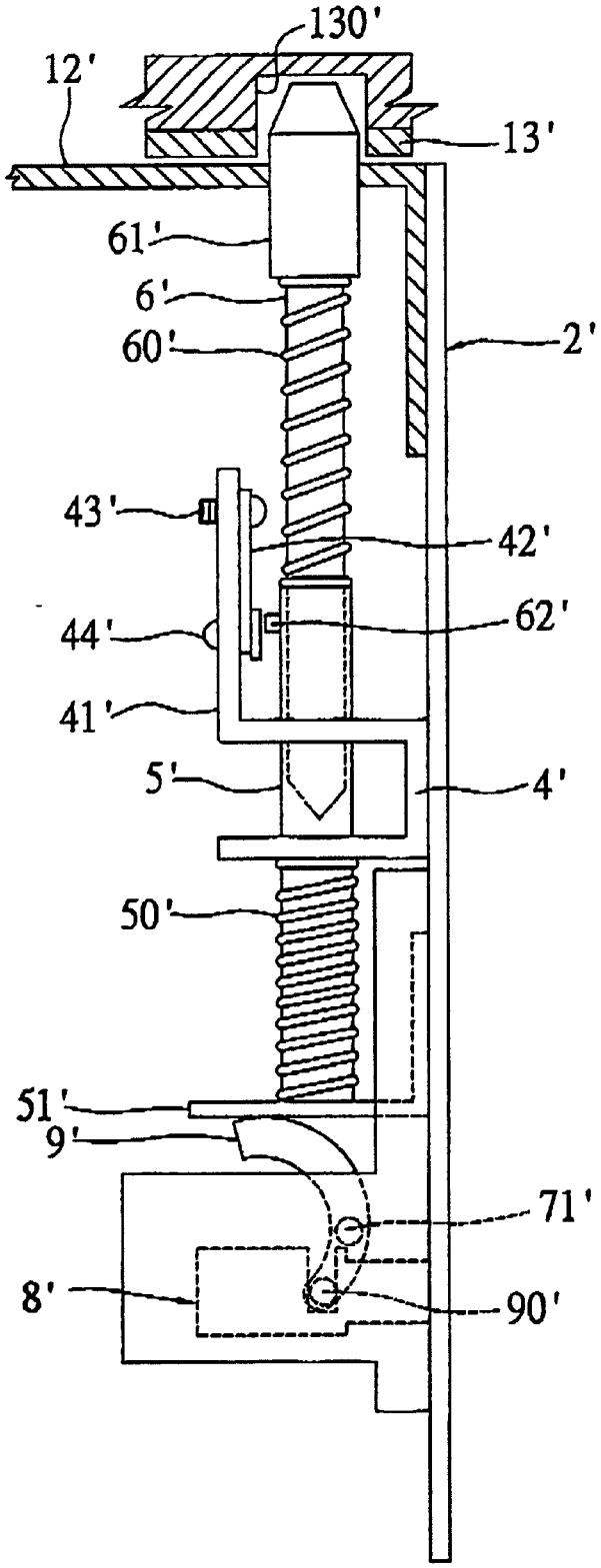
FIG. 2 (PRIOR ART)
FIG. 2 (PRIOR ART) shows the same of FIG. 1 except when the actuating bolt is being pushed inwards by the closing of one panel of the paired panic door.
Figure 3:
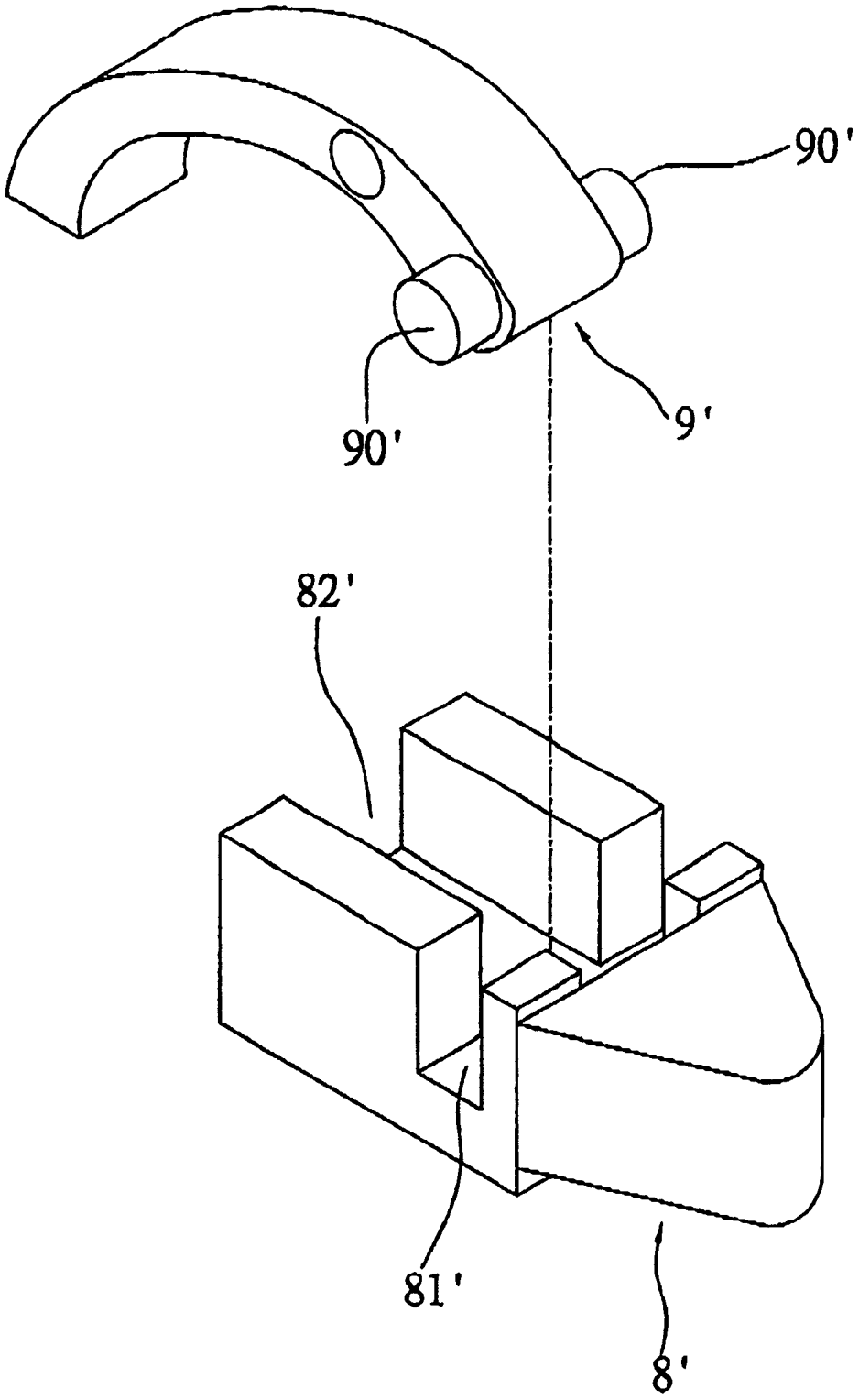
FIG. 3 (PRIOR ART)
FIG. 3 (PRIOR ART) is a schematic exploded pepective view of the actuating mechanism in the locking device of FIG. 1.
Figure 4A:
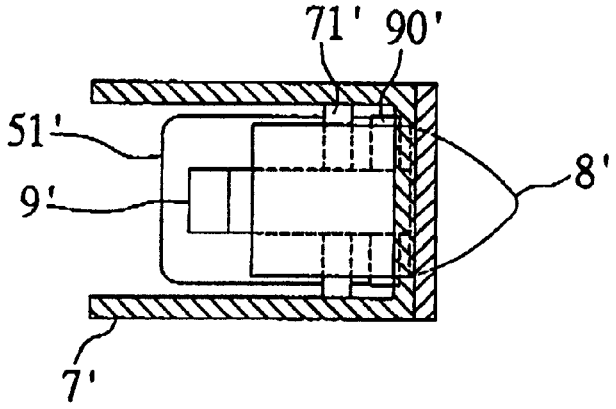
FIG. 4A (PRIOR ART)
FIG. 4A (PRIOR ART) is a schemtic top vew of the actuating mechansm when its actuating bolt is protruded out.
Figure 4B:
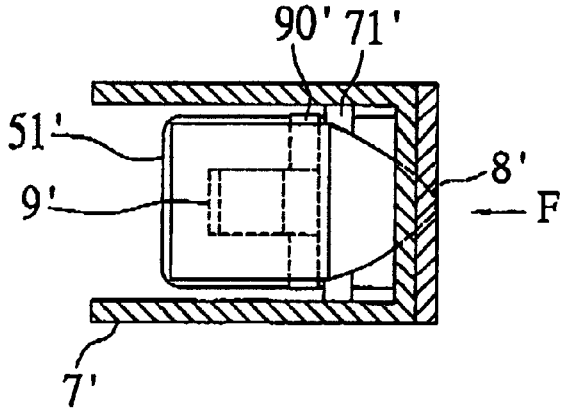
FIG. 4B (PRIOR ART)
FIG. 4B (PRIOR ART) shows the same of FIG. 4A except when the actuating bolt is being pushed inwards.
Figure 4C:
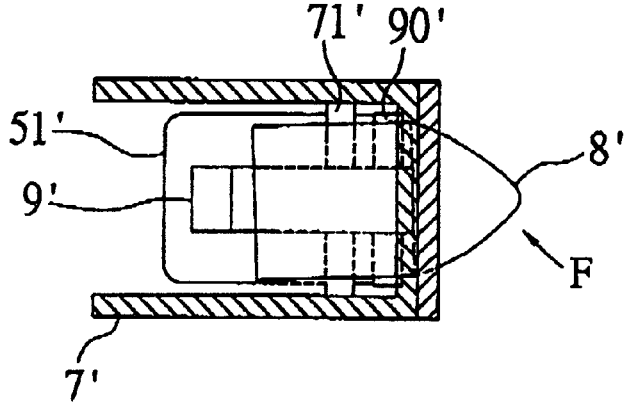
FIG. 4C (PRIOR ART)
FIG. 4C (PRIOR ART) shows the same of FIG. 4B except when the actuating bolt is undesirbly tilted.

Comparing FIG. 7 with FIG. 3, it can be learned that the actuating bolt 8 utilized by the invention is simpler in structure than the actuating bolt 8' utilized by the prior art. The lockimg device of the invention is therefore more cost-effective to manufacture than the prior art.

Referring back to FIG. 5, the locking device can be further provided with a thermal member 44 mounted on one end of the fire-proof elastic piece 42 which is secured in position on the upright portion 41 of the mounting frame 4 by means of a screw 43. In the event of a fire when the locking device is in locking state illustrated in FIG. 6, the thermal member 44 would be melted down, thus freeing the fire-proof elastic piece 42. As a result, as illustrated, in FIG. 6. the fire-proof elastic piece 42 can elastically flip up against the movable tube 5 and thereby catch the peg 62 on the slidable bar 6, making the latching bolt 61 unable to withdraw from the recess 130 to the U-shaped frame 120. This can help pevent the paired panic doors from being opened in the event of a fire, thereby preventing the fire from spreading through the paired panic doors.

Figure 11:
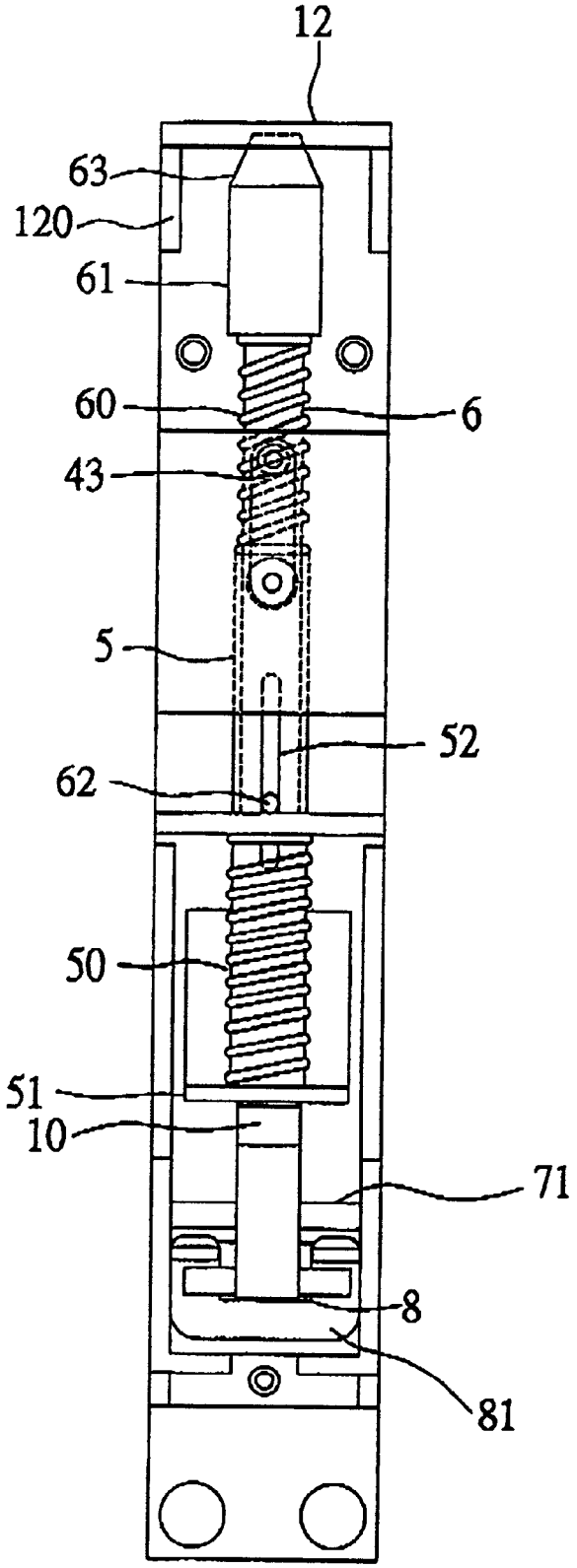
FIG. 11 shows a side view of FIG. 10 except when the latching bolt is withdrawn to allow the opening of the dual-panel door in the event of a fire.

Referring to FIG. 11, when the paired panic doors are locked due to the thermal member 44 being melted down in the event of a fire, the fire fighters can open the paired panic doors simply by knocking forcefully against the door panel, which can cause the latching bolt 61 to be slightly withdrawn into U-shaped frame 120 the casing 10 due to its inclined surface 63, thereby causing the slidable bar 6 to be forcefully moved down and thus break the fire-proof elastic piece 42. As a result, the latching bolt 61 can be completely withdrawn from the recess 130, allowing the paired panic doors to be opened.

The invention bas been described using exemplary prefered embodiments. However, it is to be undertood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. In a locking device comprising an actuating bolt, a pivotable member engaged by the actuating bolt and being turnable when the actuating bolt is pushed inward, a movable tube adapted to move axially when the pivotable member is being turned, a slidable bar connected to the movable tube, a first spring member mounted around the slidable bar, and a latching bolt secured to the slidable bar in such a way that when the slidable bar is moved, the latching bolt extends out of the locking device, the improvement wherein the actuating bolt is substantially triangularlyshaped body having a stopper portion defining a rear surface of the actuating bolt and a recess in said stopper portion, and the pivotable member has a pair of opposite guide pegs slidably abutting the rear surface of said stopper portion.

2. The locking device of claim 1, further comprising means for preventing the latching bolt from being withdrawn in the event of a fire.

3. The locking device of claim 2, wherein the preventing means includes a fire-proof elastic piece, and flier comprising a thermal member which fixes one end of the fire-proof elastic piece and is capable of being melted down in the event of fire and a screw which fixes the other end of the fire-proof elastic piece.

4. The locking device of claim 1, wherein the pivotable member is curved in shape.

5. The locking device of claim 1, further comprising a second spring member mounted around the slidable tube.

* * * * *